US005606864A

United States Patent [19]

Jones

[11] Patent Number: 5,606,864

[45] Date of Patent: Mar. 4, 1997

[54] ICE BANK CONTROL FOR A BEVERAGE DISPENSING MACHINE

[75] Inventor: Brian C. Jones, Collinsville, Conn.

[73] Assignee: Wilshire Partners, Cleveland, Ohio

[21] Appl. No.: 622,026

[22] Filed: Mar. 26, 1996

[51] Int. Cl.[6] ..... F25C 1/00; G01N 25/02

[52] U.S. Cl. ..... 62/139; 374/16; 374/21

[58] Field of Search ..... 62/139–138, 394; 374/21, 16; 340/590

[56] References Cited

U.S. PATENT DOCUMENTS

| | | | |
|---|---|---|---|
| 2,512,066 | 6/1950 | Linfor | 62/139 |
| 2,674,101 | 4/1954 | Calling | 62/139 |
| 4,008,832 | 2/1977 | Rodth | 222/129.1 |
| 4,497,179 | 2/1985 | Iwans | 62/59 |
| 4,823,556 | 4/1989 | Chesnut | 62/139 |
| 5,022,233 | 6/1991 | Kirschner | 62/138 |
| 5,502,977 | 4/1996 | Ziesel et al. | 62/139 |

*Primary Examiner*—William E. Wayner
*Attorney, Agent, or Firm*—Vickers, Daniels & Young

[57] ABSTRACT

An ice bank control for use in controlling the size of an ice bank in an ice water tank in a beverage dispenser utilizes an especially constructed probe having a sealed tubular member containing an electrolyte treated water well therein. An electrode extends into the water well and a ground is in contact with the water well so that the probe senses the existence of ice at a point within the tank while the tubular member insulates the electrode and ground from contact, electrical and physical, with the contents of the ice water tank.

23 Claims, 6 Drawing Sheets

ICE BANK CONTROL FOR A BEVERAGE DISPENSING MACHINE

This invention relates generally to beverage dispensing machines and more particularly to an ice bank control system used in beverage dispensing machines.

The invention is particularly applicable to and will be described with specific reference to an improved sensing probe having particular application to controlling formation of ice in the ice water tank of a beverage dispensing system. However, those skilled in the art will recognize that the invention may have broader application and could be used to control the formation of ice or solids of any liquid bath in which the liquid undergoes a phase change which is to be controlled.

INCORPORATION BY REFERENCE

The following United States patents are incorporated by reference herein and made a part hereof so that details of beverage dispensing machines conventionally known in the art and also details of conventional ice bank controls used in such machines need not be set forth in detail herein:

U.S. Pat. No. 5,022,233 issued Jun. 11, 1991 entitled "Ice Bank Control system for Beverage Dispenser".

U.S. Pat. No. 4,823,556 issued Apr. 25, 1989 entitled "Electronic Ice Bank Control".

U.S. Pat. No. 4,008,832 issued Feb. 22, 1977 entitled "Three Drink Gravity Dispenser for Cool Beverages"

U.S. Pat. No. 4,497,179 issued Feb. 5, 1985 entitled "Ice Bank Control System for Beverage Dispenser"

The patents incorporated by reference herein do not form part of the present invention.

BACKGROUND OF THE INVENTION

Beverage dispensing machines conventionally employ an ice water tank in which the evaporator coil of a refrigeration unit is placed as well as beverage tubing coils through which beverage product (syrup, carbonated water and water) flows. The temperature of the ice water tank is ideally maintained at 32° F. to chill the water and syrup when dispensed through the machine's dispensing valve. Chilling of the beverage product occurs by conductive heat transfer across the tubing wall. To satisfy peak demand, the refrigeration unit is operated to build an ice bank about the evaporator coils so that the ice will provide an additional heat sink or cold storage to compensate for increased flow of the warmer fluids in the water and syrup coils. Chilling of the beverage product causes some of the ice to melt. The compressor of the refrigeration unit is then operated to replenish the ice.

The ice bank size must be controlled within a specified size range. For example, if the ice bank is too small, there may not be enough cold storage to satisfy periods of high cooling demand. However, if the ice bank becomes too large, it may grow into the beverage product coils causing the beverage product to freeze and rendering the beverage dispenser inoperable.

An ice bank control is conventionally used to cycle the refrigeration compressor and maintain the ice bank within an acceptable size range. Conventional ice bank controls use a sensor immersed at a preset location in the ice water tank to detect the presence of ice. As ice surrounds the sensor, the control detecting the presence of ice switches the compressor off. As the ice gradually melts away from the sensor, the control no longer detects ice and switches the compressor on. The cycle repeats itself indefinitely.

Two types of ice bank controls, mechanical and electronic, are in conventional use. The most popular are the mechanical controls which have been used for several decades. These controls typically employ a sensing bulb immersed in the ice water tank. The bulb is filled with water which itself freezes when surrounded by ice. When the bulb water freezes, the water (now ice) expands and pushes against a rubber diaphragm constructed in the sensing bulb. The diaphragm in turn pushes against a non-freezing ethylene glycol solution and pressure developed in the glycol solution is transmitted via a capillary tube to a piston assembly. The piston assembly, located outside the ice water tank, expands a rubber cup to push a piston against a spring lever mechanism which in turn actuates an electrical switch to deenergize the compressor. As the ice bank melts away from the sensing bulb, the reverse process occurs and the switch closes to actuate the compressor.

The mechanical control has been popular for many years because of its low cost and simplicity of operation. However, the control is very unreliable due to manufacturing variances and simply inherent mechanical wear. For example, faulty diaphragms or seals, leaking glycol, sticking pistons and improperly formed levers often cause intermittent compressor cut-in or cut-out. In a worst case failure mode, the mechanical control may cause the compressor to run continuously. This can cause the entire ice water tank to freeze up and extensively damage the beverage dispenser.

Electronic ice bank controls have been developed in recent years to provide increased reliability and this invention relates to an electronic control. Electronic control systems use an electrode assembly immersed in the ice water tank to sense the presence of ice. In its basic application, a low alternating current voltage (typically 9 volts) is applied to one pole of the electrode. Some electronic controls use pulsed direct current. Another electric pole is referenced to ground. Ice having a much higher electrical resistance than water, can be detected by comparison of electrical resistance across the electrode poles. A control board electrically connected to the electrode assembly is used to make the resistance comparisons and provide output switching action to operate the compressor.

U.S. Pat. Nos. 4,008,832 and 4,497,179 illustrate conventional electronic controls in which two probes are placed in the ice water tank in closely spaced alignment with the evaporator coil. The probe furthest from the evaporator senses water and the probe positioned closest to the evaporator senses ice. The compressor is cycled on when the ice probe detects water and off when the water probe detects ice. .While such arrangements as disclosed in the '832 and '179 patents have proven more reliable than the mechanical sensor arrangement described above, they are susceptible to failures in that contaminants, such as syrup within the ice water tank, can lower the freezing point of the tank. Water in the water coil then freezes rendering the dispenser inoperable. Still further, as a function of time, deposits from the ice water tank, resulting from evaporation for example, varies the resistivity of the probes adversely affecting their readings. In this connection, U.S. Pat. No. 4,823,556 teaches the use of four separate probes, two of which generate a resistance signal depending on the actual ice water tank conditions which then serves as the basis upon which ice and water probe signals are compared against to cycle the compressor off and on. The assumption is that all the probes will uniformly degrade so that the comparison will be viable. U.S. Pat. No. 5,022,233 offers another solution to the drift and/or probe degradation problem. In the '233 patent only one probe, precisely positioned where the desired ice-water interface is desired to occur, is used and the circuitry for shutting off and on the compressor includes a programmable microprocessor that compares the readings obtained over time and automatically correlates or adjusts them to the desired beta curve to account for drift.

In summary, a number of problems arise in conventional, electronic ice bank control systems which can be attributed to the fact that the sensor or the probe is in contact with the contents of the ice water tank. As noted, water deposits lead to contamination of the probe affecting its readings. Impurities such as syrup in the tank adversely affects the controls by lowering the freezing temperature of the tank. Because the sensor must be immersed in the tank an electrical short between the lead wires, caused by faulty insulation, can result. Stray voltage in the ice water tank can be transmitted to the electrodes. The prior art teaches to address the problems by using circuitry and/or software downstream of the probe in the control circuit. This approach increases the price of a system which is already more expensive than the mechanically equivalent system discussed above. Fundamentally though, the prior art reacts to the problem instead of addressing the problem. Should the control circuit be designed to not accurately respond to the problem encountered by the probe, or worse yet, fail to address the specific malfunction of the probe, the system will fail.

In addition to this inherent problem present in the electronic control systems of the prior art, special steps must be taken by means of specially designed bracket/spacers to accurately place the probe in desired spaced and orientation relationship to the evaporator coil. This necessitates disassembly or removal of the refrigeration deck of the beverage dispenser to gain access to the evaporator coils. The bracket has to be designed and applied in such a manner that the sensor doesn't move while ice grows and dissipates about it. When several sensors are used, typically encased in a bulb attached to the evaporator coil, care must be taken to assure that the sensors extend on a radial line from the center of the evaporator tubing. Such requirements make it difficult and/or expensive to retrofit mechanically equipped ice bank control beverage dispensers with electronic ice bank controls. It also makes replacing failed sensors difficult.

SUMMARY OF THE INVENTION

Accordingly it is a principal object of the invention to provide an electronic ice bank control in a beverage dispensing system which is consistently reliable because it avoids the contamination or degradation problems afflicting prior art systems resulting from exposure of the sensor to the contents of the ice water tank.

This object along with other features of the invention is achieved in a conventional beverage dispenser which includes at least one dispensing valve for dispensing a beverage, an ice water tank, at least one beverage coil carrying at least one beverage constituent in fluid communication with the dispensing valve and extending at least partially within the ice water tank, and a mechanical refrigeration unit. The refrigeration unit includes a compressor, an evaporator coil within the ice water tank, an ice sensing probe within the ice water tank for generating electrical signals to indicate the presence of ice and a control circuit or mechanism including a first circuit for cycling the compressor off and on in response to the probe's electrical signals. The ice sensing probe of the ice bank control system has a sealed tubular member containing a water well therein, a signal electrode extending into the water well and a ground electrode within the water well whereby the probe senses the presence of ice at a precise point within the tank while being insulated from contact with the contents of the ice water tank thus avoiding all the problems of the prior art system resulting from or attributed to contact with the contents of the ice water tank.

In accordance with another important feature of the invention, the tubular member is a cylindrical tube having a closed bottom end situated within the ice water tank and containing the water well and an open top end outside the ice water tank, and a cap closing the top end of the cylindrical tube and hermetically sealing the cylindrical tube whereby the cylindrical tube isolates the water well from the ice water tank while maintaining thermal conductive contact with the contents thereof.

In accordance with yet another important aspect of the invention, the control system additionally includes a thermistor in contact with the water well and the control mechanism or circuit further includes a second circuit effective when sensing an electrical signal from the thermistor indicative of a lower temperature than that sensed by the electrode to stop the compressor thus providing a fail safe mechanism preventing excessive ice formation within the ice water tank should a failure preventing the first circuit from cycling the compressor off occur for any reason.

In accordance with still yet another important feature of the invention, the dispenser has a refrigeration deck covering the ice water tank and an opening is provided within the refrigeration deck allowing the cylindrical tube to extend therethrough in spaced relationship to the evaporator coil. A mounting arrangement adjacent the top end of the cylindrical tube is provided for securing the cylindrical tube to the deck whereby the probe can be retrofitted to existing beverage dispensers without dismantling the dispenser or requiring that the probe be positioned with a precise orientation of the electrodes with respect to the evaporator coil.

It is thus an object of the invention to provide a reliable, electronic ice bank control system by use of a probe which is isolated from the contents of the ice water tank while maintaining thermal contact therewith.

It is another object of the invention to provide an electronic ice bank control system for a beverage dispenser which has a fail safe mode to prevent excessive ice formation in the ice water tank.

It is yet another object of the invention to provide an electronic ice bank control system which can be easily applied and is ideally suitable for retrofit installation to beverage dispensers.

Still another object of the invention is to provide an improved ice bank control system which uses simple control circuitry to cycle the compressor off and on.

Still yet another object of the invention is to provide an ice bank control system for a beverage dispenser which is relatively inexpensive.

Still another object of the invention is to provide a beverage dispenser ice bank control system which is more responsive and better able to control the size of the ice bank of the ice water tank in the beverage dispenser than conventional systems.

Another important object of the invention is to provide an ice bank electronic control system which has a long life and greatly improved reliability.

These and other objects of the invention will become apparent to those skilled in the art upon reading and understanding the Detailed Description of the Invention set forth below together with the drawings described below.

BRIEF DESCRIPTION OF THE DRAWINGS

The invention may take form in certain parts and arrangement of parts, preferred and alternative embodiments of which will be described in detail in this specifications and illustrated in the accompanying drawings which form a part hereof and wherein.

DETAILED DESCRIPTION OF THE INVENTION

Figure 1:
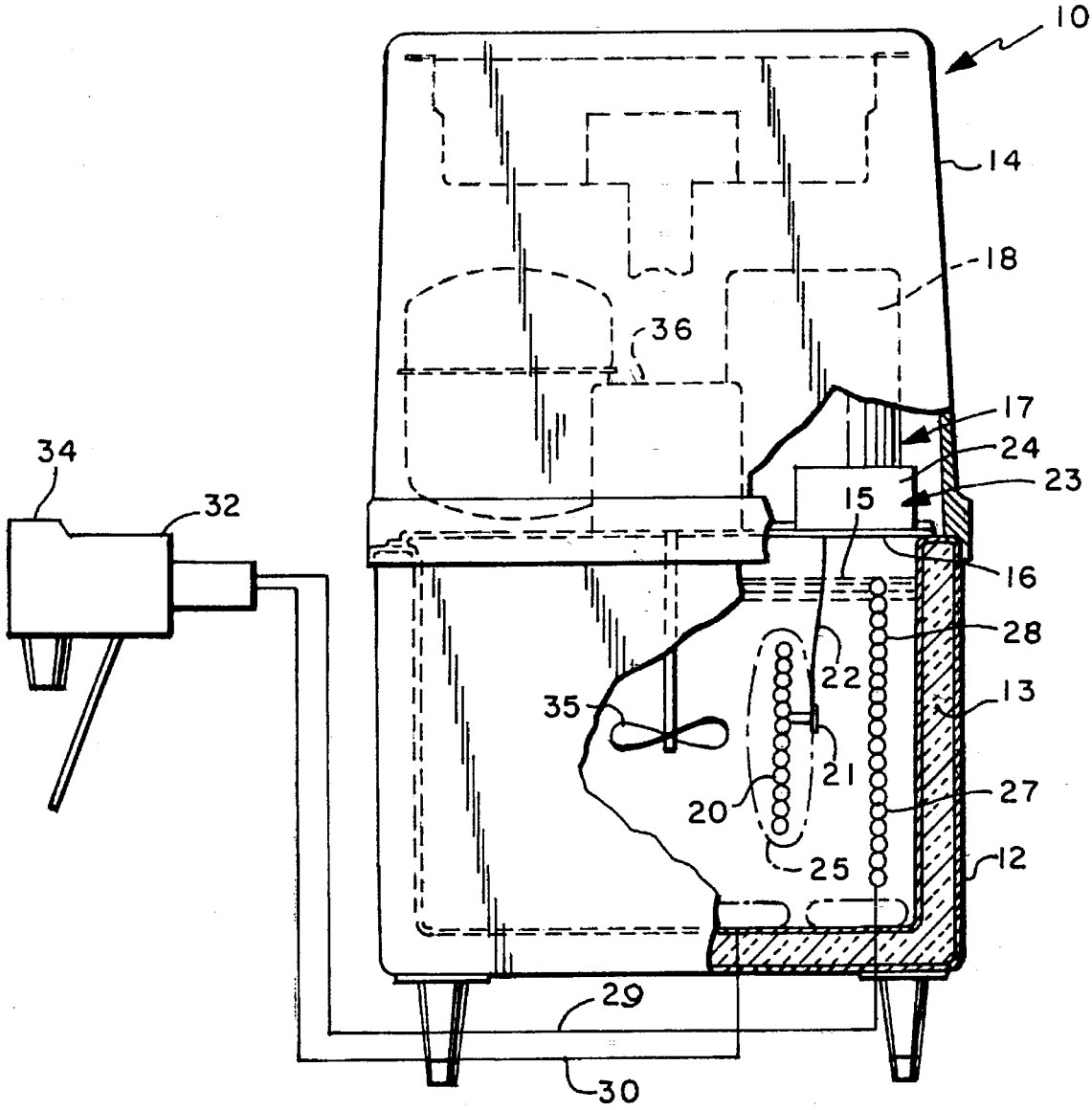
PRIOR ART FIG. 1
FIG. 1 is a schematic elevational view of a conventional beverage dispenser which also shows the dispenser and dispenser valve taken from another plane view of the dispenser.

Referring now to the drawings wherein the showings are for the purpose of illustrating a preferred embodiment as well as alternative embodiments of the invention, there is shown in FIG. 1 a conventional beverage dispensing machine or simply beverage dispenser 10 having a housing including an ice water tank 12 insulated as at reference numeral 13 and covered by a removable shroud 14. Ice water tank contains an ice water bath, the top surface of which is indicated by reference numeral 15 in FIG. 1. Covering the top of ice water tank 12 is a refrigeration deck 16 upon which is mounted a mechanical refrigeration unit 17.

Refrigeration unit 17 conventionally includes a compressor driven by an electric motor (motor and compressor indicated schematically by reference number 18) which conventionally operates to discharge a refrigerant through an expansion valve or capillary tube into an evaporator coil 20 positioned within ice water tank 12. Conventionally secured to evaporator coil 20 is a conventional ice sensor 21 having a lead 22 extending through the top surface of the ice water bath 15 and connected to an ice bank control 23 mounted within a control housing 24 secured to refrigeration deck 16. Conventional sensor 21 and ice bank control 23 operate in a known manner to control the size of an ice bank, the outer boundary of which is shown by the dot-dash line indicated by reference numeral 25.

Also positioned within ice water bath 15 are beverage product coils. A syrup coil is shown by reference numeral 27 and a carbonated water coil is shown by reference numeral 28. Beverage product passing through syrup and water coils 27, 28 is chilled by thermal conduction with ice water bath 15 and transmitted through beverage lines 29, 30 to a conventional dispensing valve 32 which mixes and discharges the drink through nozzle 34.

Also positioned within ice water tank 12 is an agitator 35 driven by electric motor 36. It is known to control the operation of agitator 35 (on-off) through ice bank control 23 in accordance with the presence or absence of ice sensed by conventional sensor 21. It is similarly contemplated to likewise control agitator through the ice bank control of the present invention.

Everything described thus far is conventional and prior art to the present invention except for the improved combination resulting therefrom.

Figure 2A:
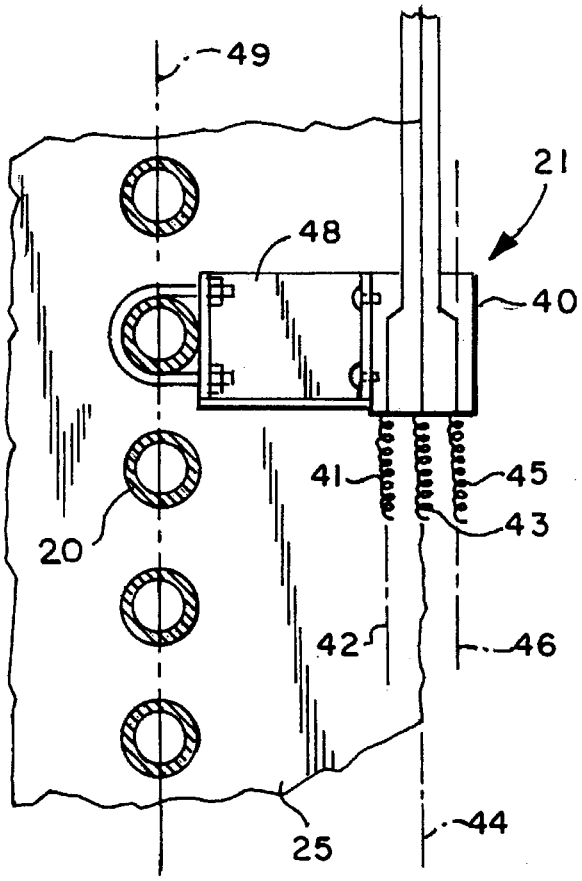
PRIOR ART Fig. 2A
FIG. 2A is a partial elevational view of a prior art probe conventionally mounted to the evaporator coil of a refrigeration unit used in a beverage dispenser.
Figure 2B:
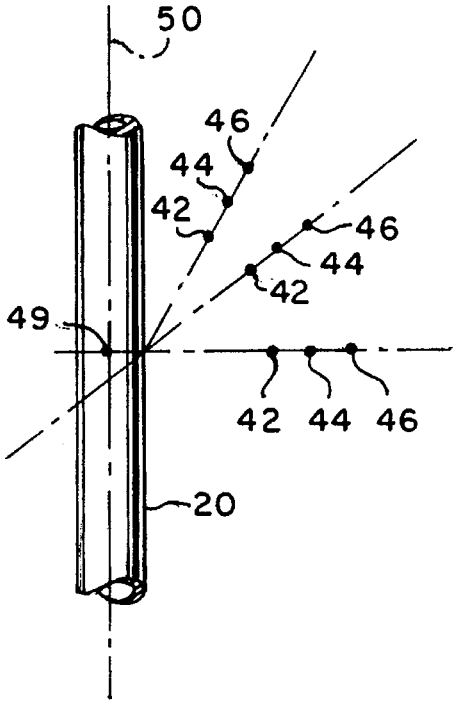
PRIOR ART Fig. 2B
FIG. 2B is a schematic construction of the alignment of the prior art probe shown in FIG. 2A viewed from the top.

Referring now to FIGS. 2A and 2B, there is shown a conventional electronic ice bank control sensor 21 mounted within a sensor housing 40 and having three electrodes, namely an ice electrode 41 extending along axis 42, a water electrode 43 extending along axis 44 and a ground electrode 44 extending along axis 46. Conventional ice bank control 23 cycles compressor 18 off and on to control the size of ice bank 25 within the positions of ice electrode 41 and water electrode 43. That is, with compressor 18 off, heat transfer between beverage coils 27, 28 raise the temperature of ice water bath 15 reducing the size of ice bank 25 as the ice melts. When ice bank 25 shrinks to a dimension exposing ice electrode 41 to water, the resistance between the ice electrode 41 and the ground electrode 45 changes and ice bank control 23 senses the change to cycle compressor 18 on. Refrigerant expands within evaporator coil 20 lowering its temperature to about 15° F. and ice begins again to build around the evaporator coil 20 within ice water bath 15. When ice bank 25 grows and reaches water electrode 43, the resistance between the water electrode 43 and the ground electrode 45 changes and conventional ice bank control 23 turns the compressor off. The cycle repeats itself indefinitely. It should also be noted that ground electrode 45 is furthest removed from evaporator coil 20 and is always exposed to water in ice bath 15. This arrangement, when operating as described inherently provides a dead or null zone during the time the ice grows and contracts between the ice and water electrodes 41, 43 which in turn prevents compressor 18 from rapidly cycling off and on. Thus when compressor 18 is on, it is on for a sufficient time length to permit steady state, efficient refrigeration operation to occur which won't happen if compressor 18 is subject to quick on-off cycles.

Conventional electronic ice bank control sensors 21 are rigidly and firmly mounted to evaporator coil 20 by any number of spacer/mounting arrangements such as shown by reference numeral 48 in FIG. 2A. As can be readily seen in FIG. 2A, ice bank 25 is maintained at its maximum dimension so long as space/mounting arrangement 48 maintains electrode centerline 42, 44 and 46 parallel with evaporator coil centerline 49. Should the spacer/mounting arrangement 48 permit sensor housing 40 to pivot about evaporator coil 12 in the plane of FIG. 2A the ice bank dimension will be smaller than shown. FIG. 2B shows that the same problem can occur in a plane orthogonal to the plane of FIG. 2A. It is possible over time, because the ice bank is growing and contracting to move the position and/or attitude of sensor housing 40 and thus adversely affect the cooling capacity of ice water tank 15.

The conventional electronic ice bank control system now described in some detail is subject to the defects discussed above besides those just described relating to its installation. The sensor leads, while insulated, extend from within ice water bath 15 to control housing 24. Should the insulation be defective either when made, installed or during use, sporadic failures will occur. As noted, should syrup or other substances leak into or contaminate ice water bath 15, the freezing point of the resultant mixture will be lowered with the result that the electronic control will drive the temperature of ice water bath below 32° F. When this happens water coil 28 freezes water flowing through the coil. The electrolyte composition in ice water bath 15 is unpredictable and could cause erroneous readings of conventional sensors 21 triggering failures of ice bank control 23. Similarly stray voltages sporadically appearing in ice water bath 15 could trigger the same result. As noted above chemical deposits resulting from evaporation and other events can also adversely affect the resistance readings of conventional temperature sensors 21. Also, as noted above, prior art approaches to this problem have been to provide additional circuitry or sophisticated electronics in ice bank control 23 to interpret the resistance readings in a "smart" manner to either discard or modify the reading to that which the "smart" logic dictates.

Figure 4:
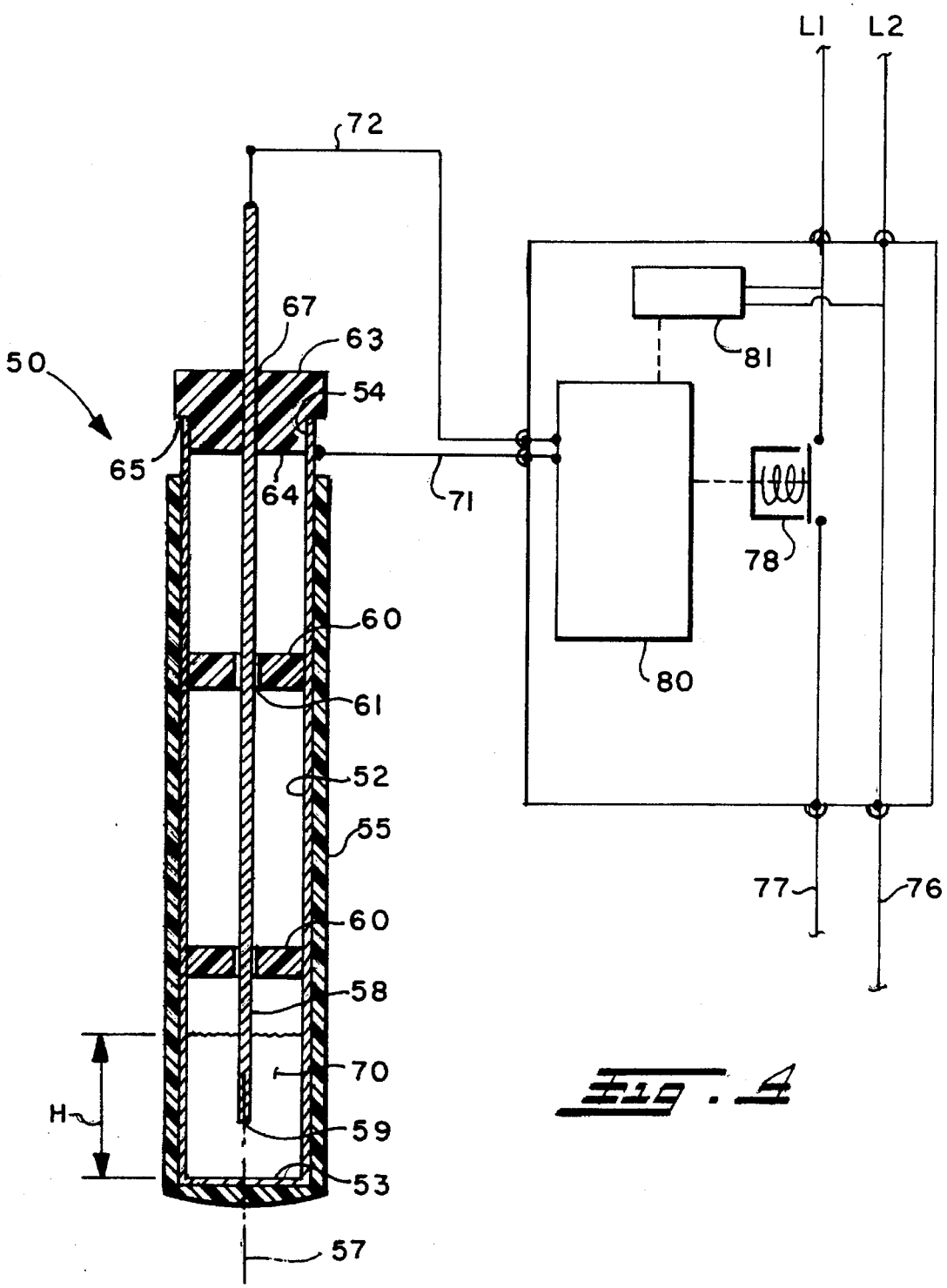
FIG. 4 is a schematic view similar to FIG. 3 but of an alternative embodiment of the present invention.

The present invention will be shown to overcome all such problems and reference should be had first to FIG. 4 which, while an alternative embodiment, nevertheless discloses the underlying principle of the invention. There is shown in FIG. 4 a sensing probe 50 (referred to as "probe" to conveniently distinguish from the prior art devices discussed above which have been referred to as "sensor") having a tubular member 52 with a closed bottom end 53 and an open top end 54. In the alternative embodiment of FIG. 4, tubular member 52 is electrically conductive and is preferably metal, preferably copper. In all embodiments, tubular member 52 is preferably cylindrical. When tubular member 52 is metal, it is preferably electrically insulated from ice water bath 15 by a coating or encapsulation 55 of plastic. Co-incident with longitudinal centerline 57 of tubular member 52 or coaxially positioned within tubular member 52 is an electrically conductive electrode 58. Electrode 58 is accurately positioned within tubular member 52 by being inserted into dielectric cylindrical bushings 60 (rubber based, neoprene or plastic) having a central opening 61 snugly receiving the electrode and a dielectric, plastic end cap 63. Plastic end cap 63 has bottom end 64 and an annular shoulder 65 which abuts the edge surface of open end 54 of electrode 58 as well as a central opening 67 through which electrode 58 extends. As noted electrode 58 is positioned within bushings 60 and extends a precise distance from bottom end 64 of cap 63. When the electrode assembly is fitted into tubular member 52, bottom end 59 of electrode 58 will be positioned a precise fixed distance from bottom end 53 of tubular member 52. Before electrode 58, bushings 60 and end cap 63 are fitted into tubular member 52 a quantity of water is placed into the bottom of tubular member 52 filling tube member 52 to a fixed height shown as letter H in FIG. 4. This water comprises a water well providing an electrically conductive path between electrode 58 and tubular member 52. Importantly the water is distilled and treated with a desired concentration of electrolyte so that the water has desired electrical characteristics producing desired resistance to temperature characteristics for ice bank probe 50. When the electrode assembly as defined is inserted into tubular member 52 electrode 58 is precisely positioned within water well 70 and cap 63 is thoroughly sealed by an appropriate glue such as epoxy to tubular member 52 (as well as sealing cap opening 67) sufficient to establish an air or hermetic seal of tubular member 58 preventing any contamination or degradation of water well 70.

A ground wire 71 is soldered to tubular member 52 and an electrode wire 72 is soldered to electrode 58. Ground and electrode wires 71, 72 are plumbed into an electrical control board 74 which is functionally equivalent to prior art ice bank control 23 and employs conventional circuits similar to those used in prior art ice bank controls to measure the resistance readings generated by probe 50 and cycle compressor 18 on and off in response to such readings.

Line voltage i.e. (120 v. AC) is supplied at L1 and L2 to electrical control board 74 and switched on and off to compressor 18 via lines 76, 77 by means of an electrically powered relay 78 which in turn is actuated by a control circuit 80. The control circuit 80 senses resistance changes of probe 50 via leads 72, 71. A voltage conditioning circuit 81 provides a low AC voltage supply (typically 6–8 volts) through control circuit 80 to electrode 58 and similarly provides a voltage supply for biasing control circuit 80. Grounding may be provided as desired. "Ground" is used herein generally to mean a signal reference point. Control circuit 80 establishes the level of resistance between electrode 58 and tubular member 52 (when metallic) through leads 71–72. A "low" resistance indicates the presence of water in water well 70 and a "high" resistance establishes the presence of ice in water well 70. When a low resistance is sensed, control circuit 80 actuates relay 78 to close the switch and power compressor 18. When a high resistance is sensed, control circuit 80 deenergizes power relay 78 and opens the switch to shut off compressor 18. The only moving part in the system is power relay 76. With electrode 58 centered, as is preferred, the sensing electrodes are axially symmetrical. The orientation of the probe is not critical.

Figure 5:
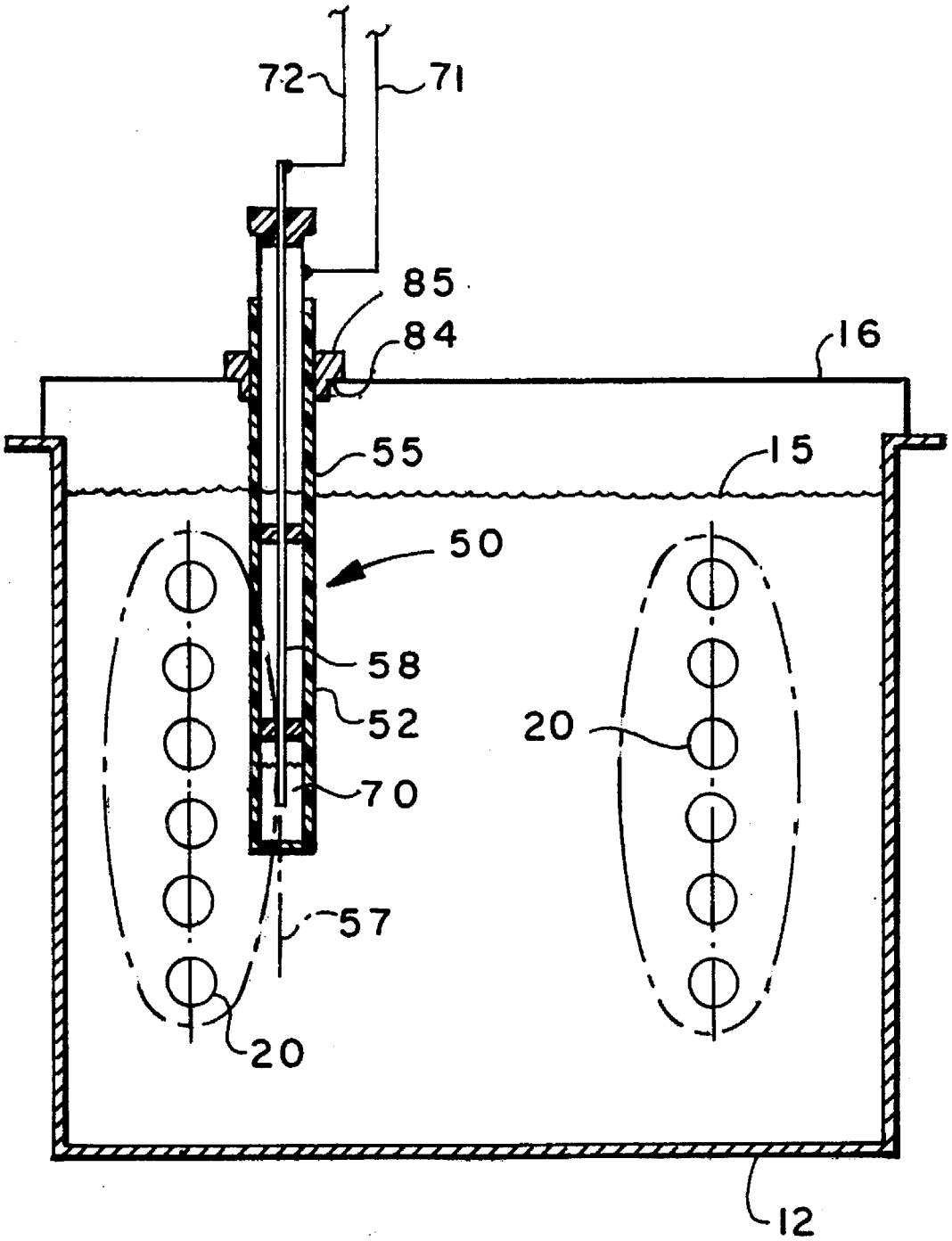
FIG. 5 is a schematic elevational view showing the probe of the present invention applied to an ice water tank of a beverage dispenser; and, FIG. 6 is a view similar to FIG. 4 showing a third embodiment of the present invention.

FIG. 5 illustrates ice bank probe 50 applied to tank 12. Tubular member 52 including plastic encapsulation 55 extends beyond ice water bath 15 through refrigeration deck 16 so that electrode leads 72 and 71 do not extend through ice water bath 15 and are thus not subject to the lead wire failures attributed to ice water bath 15 which afflicts prior art sensors. Ice bank probe 50 is positioned so that well water 70 is at any desired distance from evaporator coil 20 whereat the boundary of ice bank 25 is desired. Only one probe 50 need be used. Well water 70 is in direct thermal contact with the contents of ice water bath 15 by conduction through tubular member 52 (and plastic encapsulation 55) and conduction is uniform from ice water bath 15 to well water 70. At the same time well water is isolated from direct as well as electrical contact with ice water bath 15. Sediments and foreign contaminants will not affect probe 50 since well water 70 is shielded therefrom and it is not likely that such contaminants will adversely affect thermal conductivity between well water 70 and ice water bath 15. Stray voltages within ice water bath will not adversely affect probe 50 because of plastic encapsulation 55. Importantly, should the ice water bath 15 become contaminated and its freezing point drop below 32° F., the probe 50 will continue to maintain the ice water bath at 32° F. At this temperature, probe 50 will detect the presence of ice in well water 70 even though the water bath has not frozen to form an ice bank. Thus freeze up of water within water coil 28 will not occur.

Importantly the problem discussed with the prior art with reference to FIGS. 2A and 2B does not exist with probe 50. This is because water well 70 is essentially a point source. Radial orientation about longitudinal axis 57 does not affect the ability of ice bank probe 50 to accurately detect the presence of water and ice within a well member 70. Because of this feature, inherent in the design of probe 50, the probe can be applied to ice water tank 12 by simply fastening the top end of tubular member 52 to refrigeration deck 16 without consideration to radial orientation about its longitudinal axis 57. A hole 84 is simply drilled into refrigeration deck 16 and probe dropped through a selected vertical distance and secured at its top to refrigeration deck 16. No tie with evaporator coil 20 is necessary. Retrofit application of probe 50 to existing beverage dispensers 10 is easy.

It is preferred that the position of the probe 50 within the ice water bath 15 be fixed with respect to distance from the evaporator coil 20. This can be accomplished by sliding the probe 50 into a ring or tube which is fixed to the evaporator coil 20. This precisely fixes the probe's distance from the evaporator and assures optimal ice bank size control. The radial orientation of the probe about longitudinal axis 57 is not critical once its distance from the evaporator is established.

The probe 50 may be mounted to the refrigeration deck 16 near its top end. A collar 85 having a set screw can be applied to the probe 50. The collar rests on the deck 16 and the set screw holds the probe in place. The collar 85 also has a portion of reduced diameter 84 which sits in the opening in the deck. Other mounting arrangements will suggest themselves to those skilled in the art.

Figure 3:
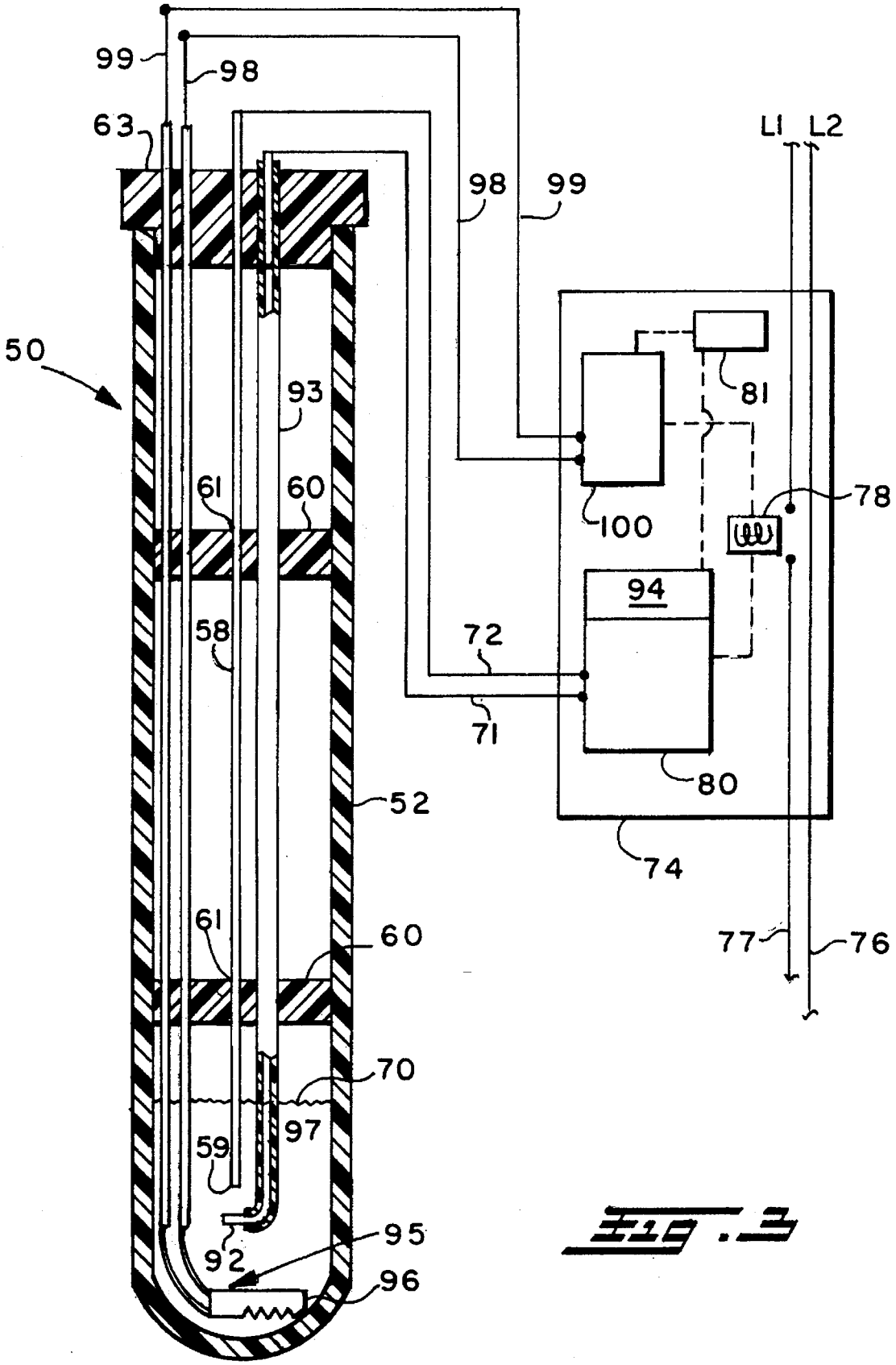
FIG. 3 is a schematic representation of the preferred embodiment of the ice bank control of the present invention.

Another embodiment of the present invention is shown in FIG. 3 and like reference numbers will be used to describe the same parts and components used with reference to FIGS. 4 through 6B. In the preferred embodiment, probe 50 has a dielectric tubular member 52. The metallic tubular member 52 and plastic encapsulation 55 shown in FIG. 4 has been replaced by a plastic tubular member 52 and an insulated second electrode 93 extending into water well 70 and connected to a second lead 71. The second electrode has an exposed tip 92 directly below the tip 59 of the first electrode 58. The remainder of the second electrode 93 is covered with insulation, such as a plastic coating 97. This arrangement materially simplifies and reduces the cost of probe 50. Control circuit 80 is functionally the same as that shown in FIG. 3. In addition, a time delay circuit 94 (having a delay of, for example 4 minutes)is added to control circuit 80. The time delay circuit 94 keeps the relay 78 closed for a minimum period of time at each actuation. This prevents damage to the compressor.

A fail safe control feature takes the form of thermistor 95 (or a resistive temperature device, i.e., RTD) having a sensing element 96 potted within or on the probe preferably positioned at the bottom of water well 70. Leads 98, 99 for thermistor sensing element 96 are threaded through additional openings in bushings 60 and end cap 63 and connected to a fail safe control circuit 100 on control circuit board 74. Fail safe control circuit 100 is similar to control circuit 80 but does not employ any time delay circuit so that it is instantly activated. Fail safe control circuit 100 operates independently of control circuit 80 and is set to deenergize power relay 78 when the temperature of ice formed in water well 70 reaches a preset level, typically 20° F. Should there be a failure for whatever reason in electrode 58, second electrode 93 or first control circuit 80 which causes compressor 18 to remain on and build excessive ice, thermistor 95 will sense abnormally low temperature and override control circuit 80 and shut off compressor 18. The thermistor 95 exhibits a precise resistance to temperature relationship and therefore small resistance changes at the lower temperature, i.e., 20° F. will accurately and repeatedly occur. The fail safe control circuit 100 can set a specific resistance value correlated to a specific ice temperature within the water well and shut off the compressor at that temperature.

Figure 6:
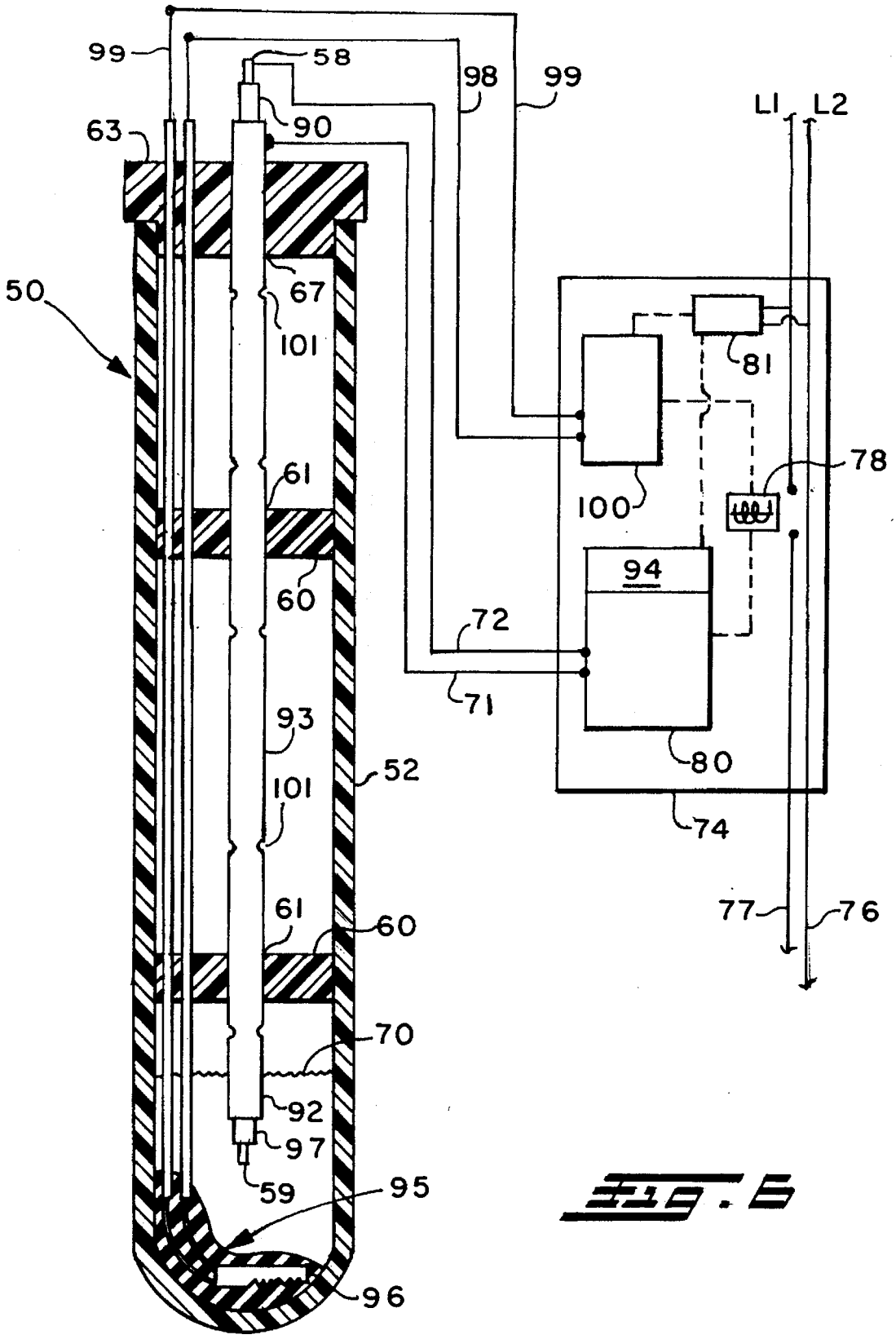

A third embodiment of the invention is shown in FIG. 6. The embodiment of FIG. 6 is identical to that of FIG. 3 except for the arrangement of the first and second electrodes. The first electrode 58 is a straight rod. An insulating tube 97 surrounds the first electrode 58. The second electrode 93 surrounds the insulating tube 97. The electrodes 58, 93 are fabricated from stainless steel to provide long term chemical stability in the probe 50. The first electrode 58 extends beyond both ends of the insulating tube 97. The insulating tube 97 extends beyond both ends of the second electrode 93. The second electrode 93 is provided with crimps 101 to maintain the electrode structure. The spacing between the tip 59 of the first electrode 58 and the tip 92 of the second electrode 93 is uniform about the axis of the probes. This embodiment is preferred as it eases manufacturing. The electrodes are assembled, crimped and placed more easily and accurately than in the other embodiments.

It is not necessary to use extensive circuitry which may store probe readings over time, compare the reading to obtain rate of change and contrast such readings to look-up tables stored in memory, etc. because of probe reading variations which would otherwise occur in conventional sensors. Because probe 50 can accurately detect minute resistance changes due to phase changes from ice to water and vice versa, a variety of sophisticated control techniques can be applied in electrical control board 74 which, in turn, can control the rate of growth and propagation of ice bank 25. The scope of this invention contemplates such applications.

The invention has been explained with reference to a preferred and. alternative embodiments. Modifications and alterations will occur to those skilled in the art upon reading and understanding the Detailed Description of the invention set forth above. For example end cap 63 could have a thermal insulation barrier applied to its end surface to make sure that ambient temperature does not adversely affect the temperature of well water 70. Two probes 50 could be utilized in a system if desired especially if the system is used to control ice growth at specific locations in ice water tank 15. Microprocessor controls could be utilized in electrical control board 74. It is intended to include all such modifications and alterations insofar as they come within the scope of the present invention.

Having thus defined the invention it is claimed:

1. In a beverage chiller for a beverage dispensing system having an ice water tank, at least one beverage coil carrying at least one beverage constituent extending at least partially within said ice water tank, and a mechanical refrigeration unit including a compressor, an evaporator coil within said ice water tank, a probe within said ice water tank for generating electrical signals indicative of the presence of ice in said ice water tank sensed by said probe and a control circuit for cycling said compressor off and on in response to said electrical signals, the improvement comprising:

said probe having a sealed tubular member containing a water well therein;

a first electrode extending into said water well and a second electrode in contact with said water well whereby said probe senses the presence of ice in said ice water tank at a precise point within said tank while being insulated from contact with the contents of said ice water tank.

2. The improvement of claim 1 wherein said water well includes distilled water and an electrolyte.

3. The improvement of claim 2 wherein said tubular member is a cylindrical tube having a closed bottom end situated within said ice water tank and containing said water well and an open top end outside said ice water tank, and a cap closing said top end of said cylindrical tube and hermetically sealing said cylindrical tube whereby said cylindrical tube isolates said water well from said ice water tank while maintaining thermal conductive contact therewith.

4. The improvement of claim 3 wherein said first electrode and said cylindrical tube are electrically conductive; said cylindrical tube forming said second electrode and a lead secured to said cylindrical tube adjacent said top end.

5. The improvement of claim 4 wherein a positioning tube receives said cylindrical tube within said ice water tank.

6. The improvement of claim 5 wherein said positioning tube is an electrically insulated plastic encapsulating said cylindrical tube.

7. The improvement of claim 6 further including a thermistor potted in contact with said probe and spaced from said first electrode and said circuit means effective when sensing an electrical signal from said thermistor indicative of a selected low temperature to stop said compressor thus providing a fail safe mechanism preventing excessive ice formation within said ice water tank should a failure of the electrode actuated control occur.

8. The improvement of claim 3 wherein said cylindrical tube is electrically insulated and said second electrode extends into said well water spaced from said first electrode.

9. The improvement of claim 8 wherein said first electrode is positioned along the axis of said cylindrical tube and said second electrode has a tip and is insulated over its length except at said tip, said tip being positioned below said first electrode.

10. The improvement of claim 8 further including a thermistor in contact with said probe and spaced from said first electrode and said circuit means effective when sensing an electrical signal from said thermistor indicative of a selected low temperature to stop said compressor thus providing a fail safe mechanism preventing excessive ice formation within said ice water tank should a failure of the first electrode and said second electrode actuated control occur.

11. The improvement of claim 10 wherein said dispenser has a refrigeration deck covering said ice water tank and an opening within said refrigeration deck allowing said cylindrical tube to extend therethrough in spaced relationship to said evaporator coil and mounting means adjacent said top end of said cylindrical tube for securing said cylindrical tube to said deck whereby said probe can be retrofitted to existing beverage dispensers.

12. The improvement of claim 5 wherein said dispenser has a refrigeration deck covering said ice water tank and an opening within said refrigeration deck allowing said cylindrical tube to extend therethrough in spaced relationship to said evaporator coil and mounting means adjacent said top end of said cylindrical tube for securing said cylindrical tube to said deck whereby said probe can be retrofitted to existing beverage dispensers.

13. An ice bank control system for a beverage dispensing system having an ice water tank, a refrigeration unit including a compressor and an evaporator coil within said tank and a beverage coil containing a constituent of the dispensed beverage within said tank, said control comprising:

a) a probe adjacent said evaporator coil having a sealed tubular member containing a water well therein; a first electrode extending into said water well and a second electrode in contact with said water well whereby said probe senses the presence of ice in said ice water tank at a precise point within said tank while being insulated from contact with the contents of said ice water tank, and b) control means including a first circuit for cycling said compressor on when said probe's signal indicates the presence of water in said water well and off when said probe's signal indicates the presence of ice in said water well.

14. The control system of claim 13 further including a thermistor in contact with said probe and spaced from said first electrode and said control means further including a second circuit effective when sensing an electrical signal from said thermistor indicative of a selected low temperature to stop said compressor thus providing a fail safe mechanism preventing excessive ice formation within said ice water tank should a failure preventing said first circuit from cycling said compressor on and off occur.

15. The control system of claim 13 wherein said tubular member is a cylindrical tube having a closed bottom end situated within said ice water tank and containing said water well and an open top end outside said ice water tank, and a cap closing said top end of said cylindrical tube and hermetically sealing said cylindrical tube whereby said cylindrical tube isolates said water well from said ice water tank while maintaining thermal conductive contact with the contents thereof.

16. The control system of claim 15 wherein said dispenser has a refrigeration deck covering said ice water tank and an opening within said refrigeration deck allowing said cylindrical tube to extend therethrough in spaced relationship to said evaporator coil and mounting means adjacent said top end of said cylindrical tube for securing said cylindrical tube to said deck whereby said probe can be retrofitted to existing beverage dispensers.

17. The control system of claim 15 wherein said cylindrical tube is electrically insulated and said second electrode extends into said well water spaced from said first electrode.

18. The improvement of claim 17 wherein said first and second electrodes are positioned coaxially along the axis of said cylindrical tube.

19. The improvement of claim 18 wherein said second electrode is a tube surrounding said first electrode over most of its length.

20. The improvement of claim 19 wherein a body of insulation separates said first electrode from said second electrode.

21. An ice probe for use in controlling the formation of an ice bank in a mechanical refrigeration unit comprising:

a sealed housing containing a body of water, a first electrode within said housing and a second electrode within said housing spaced from said first electrode, the electrical resistance between said first electrode and said second electrode having a first value when said body of water is liquid and a second value when said body of water is solid ice.

22. The probe of claim 21 wherein said housing is cylindrical and has an axis, said first electrode extending along said axis within said housing and said second electrode having a tip, said tip being positioned on said axis spaced from said first electrode.

23. The probe of claim 22 wherein said second electrode tip is the circular end of an electrically conductive tube being coaxial with said axis.

* * * * *